US009328442B2

(12) United States Patent
Seo et al.

(10) Patent No.: US 9,328,442 B2
(45) Date of Patent: May 3, 2016

(54) WASHING MACHINE

(75) Inventors: Dong Pil Seo, Hwaseong-si (KR); Sung Hoon Kim, Suwon-si (KR); Jae Ryong Park, Hwaseong-si (KR); Eun Suk Bang, Hwaseong-si (KR); Ji Yu Lee, Incheon (KR); Hwang Mook Cho, Hwaseong-si (KR); Sang Yeon Pyo, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 965 days.

(21) Appl. No.: 13/547,787

(22) Filed: Jul. 12, 2012

(65) Prior Publication Data

US 2013/0036776 A1 Feb. 14, 2013

(30) Foreign Application Priority Data

Aug. 9, 2011 (KR) ..... 10-2011-0079142

(51) Int. Cl.

| | |
|---|---|
| ***D06F 23/04*** | (2006.01) |
| ***D06F 37/40*** | (2006.01) |
| ***D06F 39/08*** | (2006.01) |
| ***D06F 39/10*** | (2006.01) |
| ***D06F 37/12*** | (2006.01) |
| ***D06F 37/14*** | (2006.01) |

(Continued)

(52) U.S. Cl.

CPC ..... *D06F 23/04* (2013.01); *D06F 37/12* (2013.01); *D06F 37/145* (2013.01); *D06F 37/206* (2013.01); *D06F 37/245* (2013.01); *D06F 37/40* (2013.01); *D06F 39/083* (2013.01); *D06F 39/10* (2013.01)

(58) Field of Classification Search

CPC ..... D06F 37/245; D06F 39/083; D06F 39/08; D06F 39/10

See application file for complete search history.

(56) References Cited

U.S. PATENT DOCUMENTS

| | | | | | |
|---|---|---|---|---|---|
| 2,554,229 | A | * | 5/1951 | Woodson | D06F 13/02 200/85 R |
| 3,772,902 | A | * | 11/1973 | Noguchi | D06F 39/10 68/18 F |
| 3,958,433 | A | * | 5/1976 | Bochan | D06F 39/08 210/359 |

(Continued)

FOREIGN PATENT DOCUMENTS

| | | |
|---|---|---|
| KR | 1996-0008353 | 6/1996 |
| KR | 10-0220930 | 6/1999 |
| KR | 2000-0033976 | 6/2000 |

OTHER PUBLICATIONS

KR10020930—Machine Translation, Sep. 1999.*

*Primary Examiner* — Michael Kornakov
*Assistant Examiner* — Marc Lorenzi
(74) *Attorney, Agent, or Firm* — Staas & Halsey LLP

(57) ABSTRACT

A washing machine includes a cabinet forming an external appearance of the washing machine, a rotary tub disposed to rotate around a driving shaft vertically provided inside the cabinet and including a sidewall, which extends with inclination to have a diameter increasing from a lower side to an upper side of the washing machine, and at least one protrusion part, which protrudes from the sidewall with inclination to have a diameter increasing from an upper side to a lower side of the sidewall. A guide water filter is mounted on at least one protrusion part inside the rotary tub and provided at a rear surface thereof with a drain passage to discharge the washing water discharged from the balance ring to outside. A base is installed at the lower side of the rotary tub and includes a guide part and a support plate.

14 Claims, 9 Drawing Sheets

(51) Int. Cl.
*D06F 37/20* (2006.01)
*D06F 37/24* (2006.01)

(56) References Cited

U.S. PATENT DOCUMENTS 4,584,732 A * 4/1986 Kohsaka ..... D06F 23/04 68/12.23
4,848,105 A * 7/1989 O'Connell ..... D06F 39/10 210/167.01
5,617,747 A * 4/1997 Kim ..... D06F 17/06 68/53
6,041,626 A * 3/2000 Jung ..... D06F 17/06 68/23.2
6,286,344 B1 * 9/2001 Jeon ..... D06F 23/06 68/173
6,389,628 B1 * 5/2002 Sears ..... D06F 37/245 68/23.2
2002/0116960 A1 * 8/2002 Nakada ..... D06F 25/00 68/18 F
2008/0216522 A1 * 9/2008 Yoo ..... D06F 39/10 68/18 F

* cited by examiner

WASHING MACHINE

CROSS-REFERENCE TO RELATED APPLICATIONS

This application claims the benefit of Korean Patent Application No. 2011-0079142, filed on Aug. 9, 2011 in the Korean Intellectual Property Office, the disclosure of which is incorporated herein by reference.

BACKGROUND

1. Field

Embodiments of the present disclosure relate to a washing machine.

2. Description of the Related Art

A washing machine is a machine configured to wash laundry by use of electricity. In general, the washing machine includes a tub to receive washing water, a rotary tub rotatably installed inside the tub, a pulsator rotatably installed at the bottom of the rotary tub, and a motor and a clutch that are configured to rotate the rotary tub and the pulsator.

As the rotary tub and the pulsator rotate in a state that laundry and detergent are introduced in the rotary tub, the pulsator stirs the washing water together with the laundry that is introduced into the rotary tub to remove dirt from the laundry.

In order to increase the washing capacity of the washing machine, the rotary tub needs to be larger, that is, needs to increase the diameter or the height. If a rotary tub has a larger size, a tub accommodating the rotary tub and the cabinet accommodating the tub also need to be enlarged along with the increase of the rotary tub.

The enlargement of the cabinet, which corresponds to the external appearance of the washing machine, is limited by the space of an area where the washing machine is installed. In addition, for a vertical shaft washing machine, the increased height of a washing machine causes a difficulty in loading and unloading laundry. Accordingly, there is a need for the washing machine capable of removing such an inconvenience.

SUMMARY

Therefore, it is an aspect of the present disclosure to provide a washing machine capable of effectively performing washing, rinsing, draining, and spin-drying operations without having a tub.

It is another aspect of the present disclosure to provide a washing machine capable of increasing the washing capacity without enlarging the external appearance.

Additional aspects of the disclosure will be set forth in part in the description which follows and, in part, will be apparent from the description, or may be learned by practice of the disclosure.

In accordance with one aspect of the present disclosure, a washing machine includes a cabinet, a rotary tub, a driving apparatus, a balance ring, a guide water filter, a base and a support plate. The cabinet forms an external appearance of the washing machine. The rotary tub is disposed to rotate around a driving shaft vertically provided inside the cabinet. The rotary tub includes a sidewall, which extends with inclination to have a diameter increasing from a lower side to an upper side of the washing machine, and at least one protrusion part, which protrudes from the sidewall with inclination to have a diameter increasing from an upper side to a lower side of the sidewall. The driving apparatus is disposed at a lower side of the rotary tub to rotate the rotary tub. The balance ring is installed at an upper side of the rotary tub to store washing water, which is discharged from the rotary tub to outside during a spin-drying operation, and to discharge the stored washing water. The guide water filter is mounted on at least one protrusion part inside the rotary tub and is provided at a rear surface thereof with a drain passage to discharge the washing water discharged from the balance ring to outside. The base is installed at the lower side of the rotary tub and includes a guide part connected to the drain passage formed on the guide water filter. The support plate is installed at the lower side of the rotary tub to support the rotary tub, stores the washing water discharged through the guide part, and discharges the stored washing water to outside.

A surface of the sidewall is blocked to prevent the washing water from being discharged to outside through the sidewall of the rotary tub when the rotary tub rotates in the spin-drying operation.

The protrusion part, is integrally formed with the sidewall of the rotary tub.

The driving apparatus includes a clutch, which is configured to rotate the rotary tub and a pulsator rotatably disposed inside the rotary tub, and a driving motor configured to drive the clutch.

The clutch includes a housing and the driving shaft which is rotatably supported by a bearing coupled to an inner side of the housing. A flange member is coupled to the lower side of the rotary tub to connect the driving shaft to the rotary tub such that a rotary force of the driving shaft is transferred to the rotary tub.

The flange member is provided at the center thereof with a first through hole, which allows the flange member to be coupled to the driving shaft, and is provided with at least one second through hole formed around the first through hole to guide the washing water stored inside the rotary tub to outside.

The balance ring installed at the upper side of the rotary tub includes a plurality of inlets to receive the washing water discharged from the rotary tub to outside when the rotary tub rotates during the spin-drying operation, and at least one outlet to discharge the washing water having been received through the plurality of inlets to outside.

The upper side of the drain passage of the guide water filter is connected to at least one outlet of the balance ring.

The lower side of the drain passage of the guide water filter is connected to the guide part of the base.

The guide water filter is vertically installed on the rotary tub, and the drain passage of the guide water filter has an area increasing from the upper side to the lower side of the sidewall to correspond to an inclination surface of at least one protrusion part which is inclining and protruding from the sidewall to have a diameter increasing from the upper side to the lower side of the sidewall.

The guide water filter includes a water filter mounting part configured to mount a water filter that filters out foreign substances.

The support plate stores the washing water discharged through the guide part of the base, and is provided with at the lower side thereof with a drain hole to discharge the washing water stored in the support plate.

The washing machine further includes a suspension member configured to connect the support plate to the upper side of the cabinet such that vibration generated from the rotary tub is absorbed by the suspension member.

The support plate includes at least one connecting bracket that connects to the suspension member.

In accordance with one aspect of the present disclosure, a washing machine includes a cabinet, a rotary tub, a balance ring, a guide water filter, a base and a support plate. A cabinet forms an external appearance of the washing machine. The rotary tub is disposed to rotate around a driving shaft vertically provided inside the cabinet and includes a sidewall, which extends with inclination to have a diameter increasing from the lower side to the upper side of the washing machine, and at least one protrusion part, which protrudes from the sidewall with inclination to have a diameter increasing from the upper side to the lower side of the sidewall. The balance ring is installed at a upper side of the rotary tub to store washing water, which is discharged from the rotary tub to outside during a spin-drying operation, and to discharge the stored washing water. The guide water filter is mounted on at least one protrusion part inside the rotary tub and includes a drain passage having an area increasing from the upper side to the lower side of the sidewall to correspond to an inclination surface of at least one protrusion part which is inclining and protruding from the sidewall to have a diameter increasing from the upper side to the lower side of the sidewall. The base is installed at the lower side of the rotary tub and includes a guide part connected to the drain passage formed on the guide water filter. The support plate is installed at the lower side of the rotary tub to support the rotary tub, to store the washing water discharged through the guide part, and to discharge the stored washing water to the outside.

A surface of the sidewall is blocked to prevent the washing water from being discharged to outside through the sidewall of the rotary tub when the rotary tub rotates during the spin-drying operation.

The protrusion part is integrally formed with the sidewall of the rotary tub.

The washing machine further includes a driving apparatus disposed at the lower side of the rotary tub to rotate the rotary tub. The driving apparatus includes a clutch, which is configured to rotate the rotary tub and the pulsator rotatably disposed inside the rotary tub, and a driving motor configured to drive the clutch.

The balance ring includes a plurality of inlets, which are configured to receive the washing water discharged from the rotary tub to outside when the rotary tub rotates during the spin-drying operation, and at least one outlet to discharge the washing water having been received through the plurality of inlets to outside.

The upper side of the drain passage of the guide water filter is connected to at least one outlet of the balance ring, and the lower side of the drain passage of the guide water filter is connected to the guide part of the base.

The guide water filter includes a water filter mounting part configured to mount a water filter that filters out foreign substances.

The support plate stores the washing water discharged through the guide part of the base, and is provided with at the lower side thereof with a drain hole to discharge the washing water stored in the support plate.

The washing machine further includes a suspension member configured to connect the support plate to the upper side of the cabinet such that vibration generated from the rotary tub is absorbed by the suspension member.

The support plate includes at least one connecting bracket that connects to the suspension member.

According to the present disclosure, the washing operation and the spin-drying operation are performed only by use of a rotary tub without a tub, thereby reducing water consumption during the washing and spin-drying operations.

In addition, the washing capacity is increased without enlarging the washing machine, so that a larger amount of laundry is washed at one time.

In addition, a washing machine according to the present disclosure implements the same washing capacity with a small external appearance, so that the washing machine is less limited by the space of an installation area than the conventional washing machine, and the laundry is easily loaded and thus the convenience of a user is improved.

In addition, the washing machine does not include a tub, thereby removing the noise caused when water flowing out of the hole of the rotary tub makes contact with the tub during the spin-drying operation.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
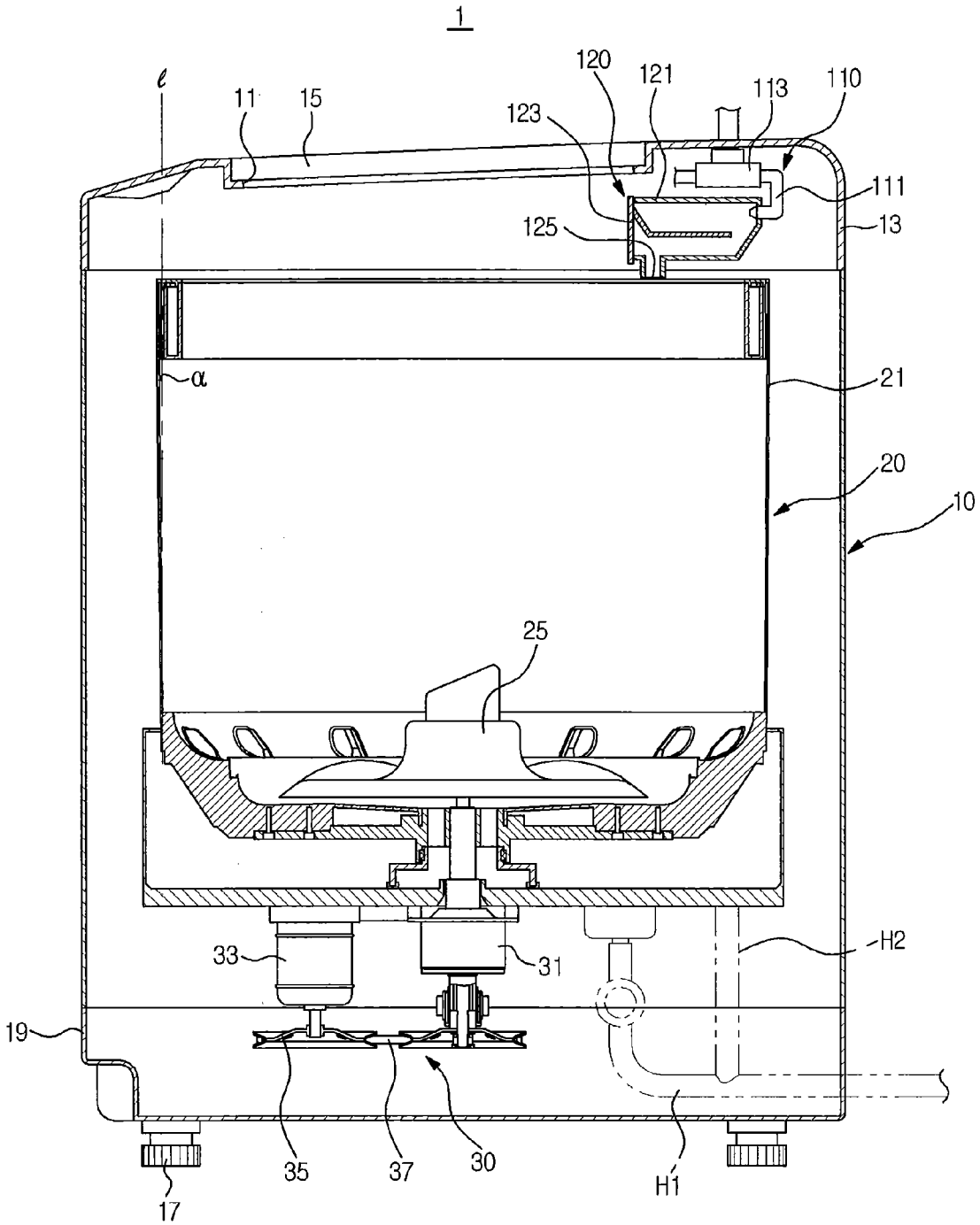
FIG. 1 is a sectional view illustrating a washing machine according to an embodiment of the present disclosure.

Reference will now be made in detail to the embodiments of the present disclosure, examples of which are illustrated in the accompanying drawings, wherein like reference numerals refer to like elements throughout.

Referring to FIG. 1, a washing machine 1 includes a cabinet 10 forming an external appearance of the washing machine 1, a rotary tub 20 rotatably disposed inside the cabinet 10, and a driving apparatus 30 disposed at a lower side of the rotary tub 20 to rotate the rotary tub 20.

The cabinet 10 is provided at an upper side thereof with an upper cover 13 having a laundry input port 11 into which laundry is loaded. A door 15 is provided on the upper cover 13 to open and close the laundry input port 11.

The cabinet 10 is provided at a lower side thereof with a lower cover 19 which is coupled to a resting part 17, enabling the washing machine 1 to be rested on a floor.

The rotary tub 20 is rotatably disposed inside the cabinet 10. The surface of the rotary tub 20 is blocked to prevent water from being discharged to outside when the rotary tub 20 rotates during a spin-drying operation.

A pulsator 25 is rotatably installed at the bottom of the rotary tub 20. The pulsator 25 stirs washing water together with laundry that is loaded into the rotary tub 20.

A water supply apparatus 110 is installed at a upper side of the rotary tub 20 to supply water to the inside the rotary tub 20.

The water supply apparatus 110 includes a water supply valve 113, which controls the supply of water, and a water supply pipe 111, which connects the water supply valve 113 to a detergent dispensing apparatus 120. The detergent dispensing apparatus 120 will be described later.

The water supply pipe 111 is connected to an external water source (not shown) at one side, and is connected to the detergent dispensing apparatus 120 at the other side.

The detergent dispensing apparatus 120 includes a case 121, which is provided inside the upper cover 13, and a detergent container 123, which is detachably mounted on the case 121 and receives detergent.

The case 121 is provided at a lower surface thereof with an outlet 125 to discharge washing water containing dissolved detergent.

Water supplied through the water supply pipe 111 is provided to the inside the rotary tub 20 together with detergent via the detergent dispensing apparatus 120.

The rotary tub 20 is provided at the lower side thereof with a first drain hose (H1) and a second drain hose (H2) that are configured to guide the washing water to the outside the cabinet 10 after a washing operation or a spin-drying operation is finished.

The driving apparatus 30 includes a clutch 31, which rotates the rotary tub 20 and the pulsator 25, and a driving motor 33, which drives the clutch 31.

The clutch 31 is connected to the driving motor 33 through a pulley 35 and a belt 37 to transfer a driving force of the driving motor 33 selectively to the rotary tub 20 or the pulsator 25.

According to the configuration of the washing machine according to the embodiment of the present disclosure, the washing capacity is increased without enlarging the external appearance, and the washing operation and the spin-drying operation are effectively performed without having a tub.

Figure 2:
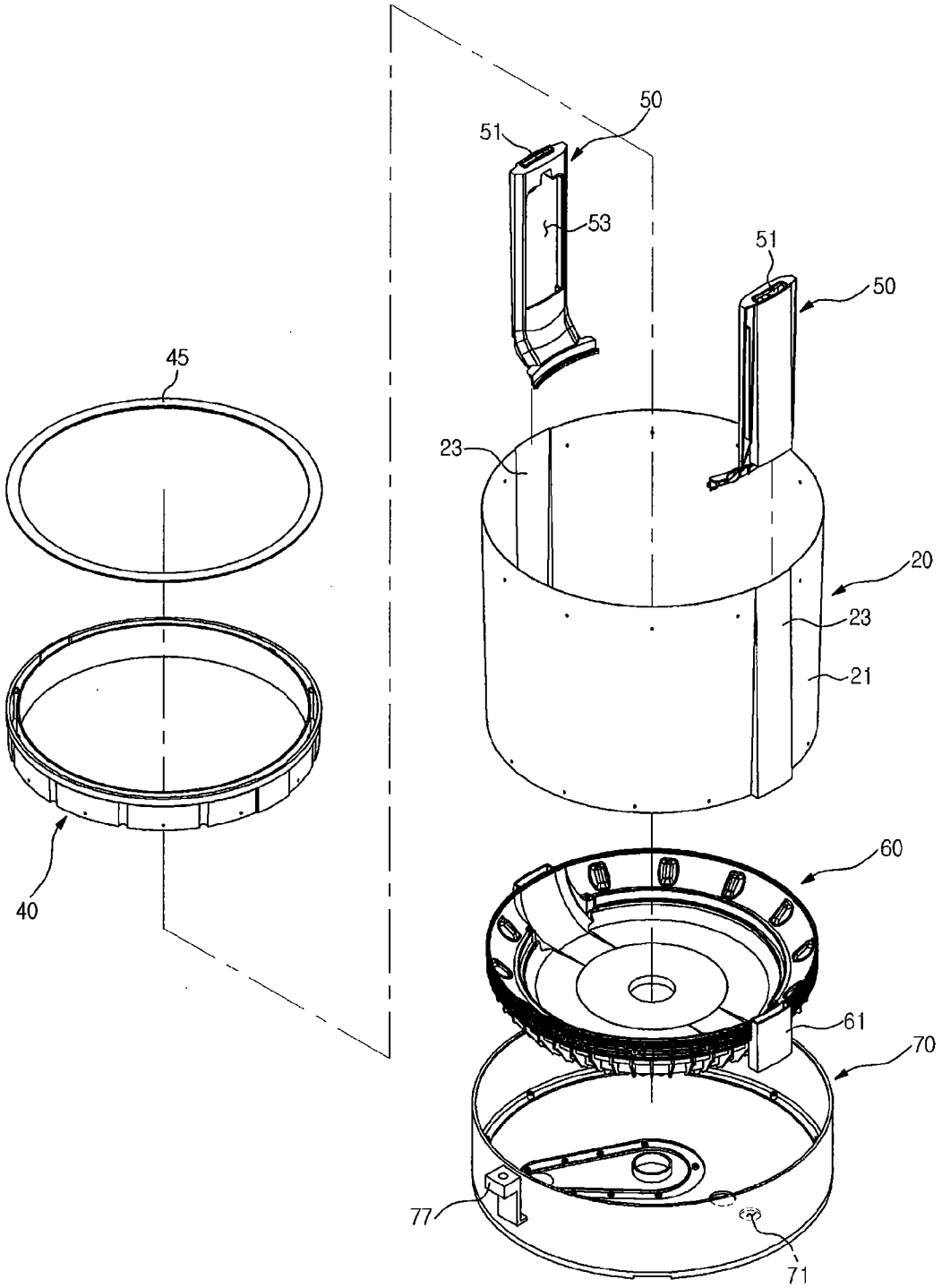
FIG. 2 is an exploded perspective view illustrating the washing machine according to the embodiment of the present disclosure.
Figure 3:
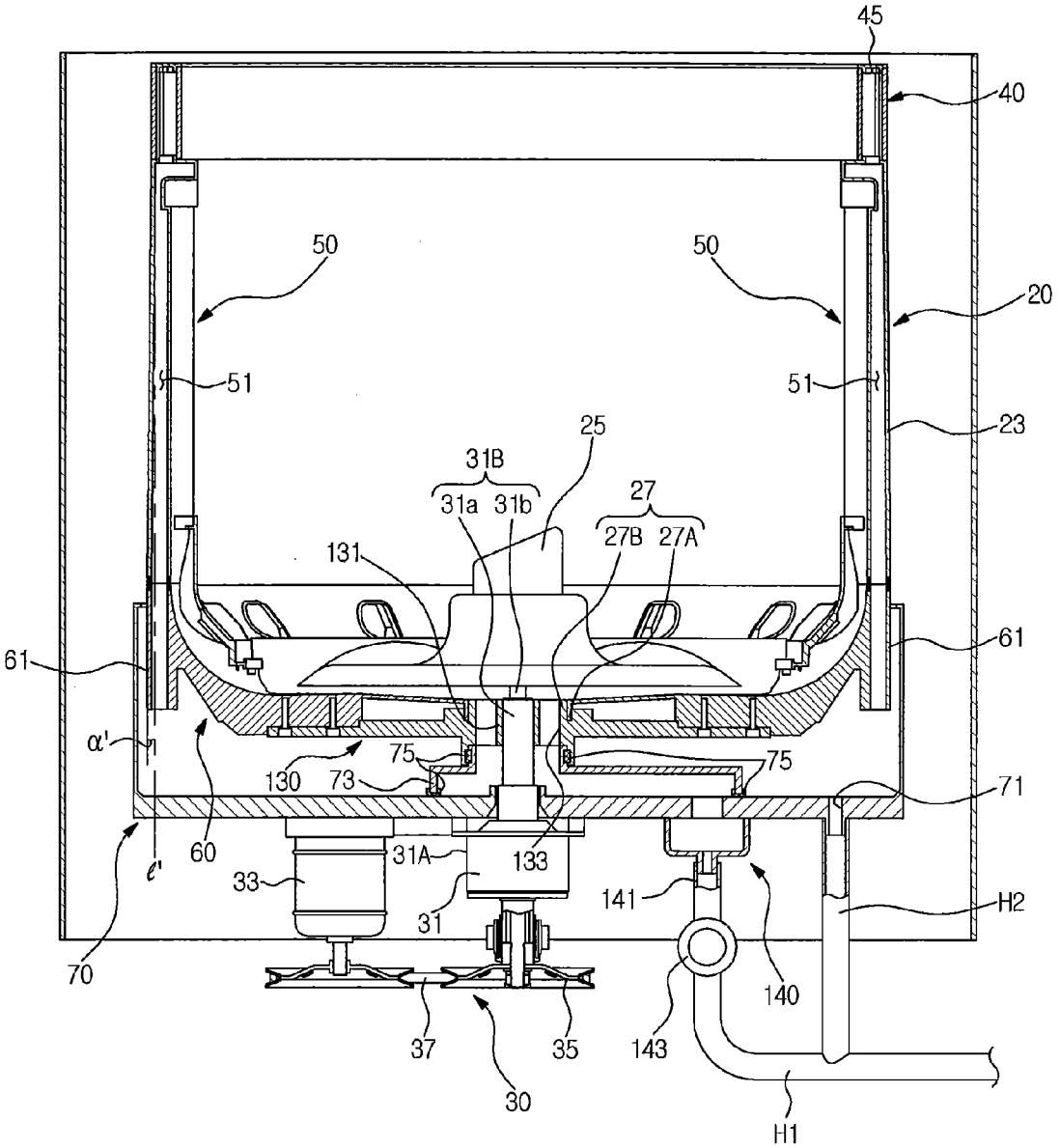
FIG. 3 is a perspective view illustrating a protrusion part formed at a sidewall of a rotary tub of the washing machine according to the embodiment of the present disclosure.
Figure 4:
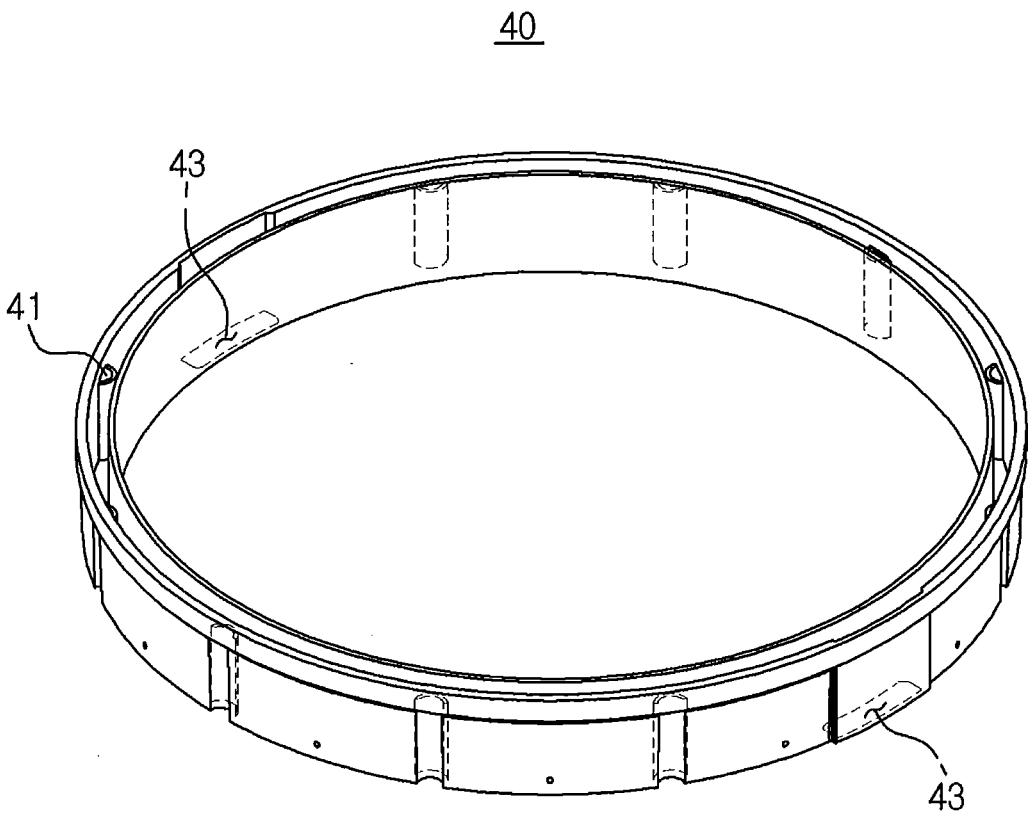
FIG. 4 is a perspective view illustrating a balance ring of the washing machine according to the embodiment of the present disclosure.

Referring to FIGS. 2 and 3, the washing machine 1 includes the cabinet 10 forming the external appearance of the washing machine 1, the rotary tub 20 rotatably disposed inside the cabinet 10, and the driving apparatus 30 disposed at the lower side of the rotary tub 20; and further includes a balance ring 40, a guide water filter 50, a base 60, and a support plate 70. The balance ring 40 is installed at the upper side of the rotary tub 20 to store washing water, which is discharged from the rotary tub 20 to the outside in a spin-drying operation, and to discharge the stored washing water. The guide water filter 50 includes a drain passage 51 to discharge the washing water discharged from the balance ring 40 to the outside. The base 60 is installed at the lower side of the rotary tub 20, and includes a guide part 61 which is connected to the drain passage 51 formed on the guide water filter 50. The support plate 70 is installed at the lower side of the rotary tub 20 to support the rotary tub 20.

The rotary tub 20 is directly disposed inside the cabinet 10 while being spaced apart from the cabinet 10 by a predetermined interval.

That is, the washing machine according to the present disclosure omits a configuration to store the washing water between the cabinet 10 and the rotary tub 20.

The rotary tub 20 is vertically provided inside the cabinet 10 as to enable rotation.

The entire surface of the rotary tub 20 is blocked to prevent the washing water from being discharged to the outside a sidewall 21 of the rotary tub 20 when the rotary tub 20 rotates during a spin-drying operation.

The rotary tub 20 includes the sidewall 21 and at least one protrusion part 23. The sidewall 21 extends with inclination to have a diameter increasing from the lower side to the upper side of the washing machine 1. At least one protrusion part 23 protrudes from the sidewall 21 with inclination to have a diameter increasing from the upper side to the lower side of the sidewall 21.

When the rotary tub 20 rotates at a rotation speed of about 280 or above in the spin-drying operation of spin-drying laundry, the washing water isolated from the laundry reaches to the sidewall 21, and then smoothly moves to the upper side of the rotary tub 20 along the inner surface of the sidewall 21 that is provided with inclination.

The sidewall 21 forms an inclination angle ($\alpha$) of about 1.2 degrees with respect to a line (I) perpendicular to the bottom surface of the rotary tub 20.

If the inclination angle ($\alpha$) is excessively small, the washing water fails to move to the upper side of the rotary tub 20 along the inner surface of the sidewall 21, so that the spin-drying performance may be degraded. If the inclination angle ($\alpha$) is excessively large, the upper side of the rotary tub 20 is enlarged, so that the overall width of the cabinet 10 may be increased.

The protrusion part 23 protrudes from the sidewall 21 of the rotary tub 20 with inclination to have a diameter increasing from the upper side to the lower side of the sidewall 21.

The protrusion part 23 is integrally formed with the sidewall 21 of the rotary tub 20 through an injection molding.

The guide water filter 50 is mounted on the inner side of the protrusion part 23. Since the protrusion part 23 is provided with inclination to have a diameter increasing from the upper side to the lower side of the sidewall 21 in opposition to the side wall 21, the drain passage 51 formed at a rear surface of the guide water filter 50 has an area increasing from the upper side to the lower side of the sidewall 21 to correspond to the inclination surface of the protrusion part 23.

Similar to the case that the washing water smoothly moves from the lower side to the upper side of the rotary tub 20 through the inclined sidewall based on centrifugal force, the configuration of the drain passage 51 having an area increasing from the upper side to the lower side of the sidewall 21 enables the water, which has reached the upper side of the rotary tub 20, to effectively move to the lower side of the rotary tub 20 and to be discharged to the outside along the drain passage 51 in the spin-drying operation.

The protrusion part 23 forms an inclination angle ($\alpha'$) of about 0.5 degrees with respect to a line (I') perpendicular to the upper side of the sidewall 21 of the rotary tub 20.

Figure 5:
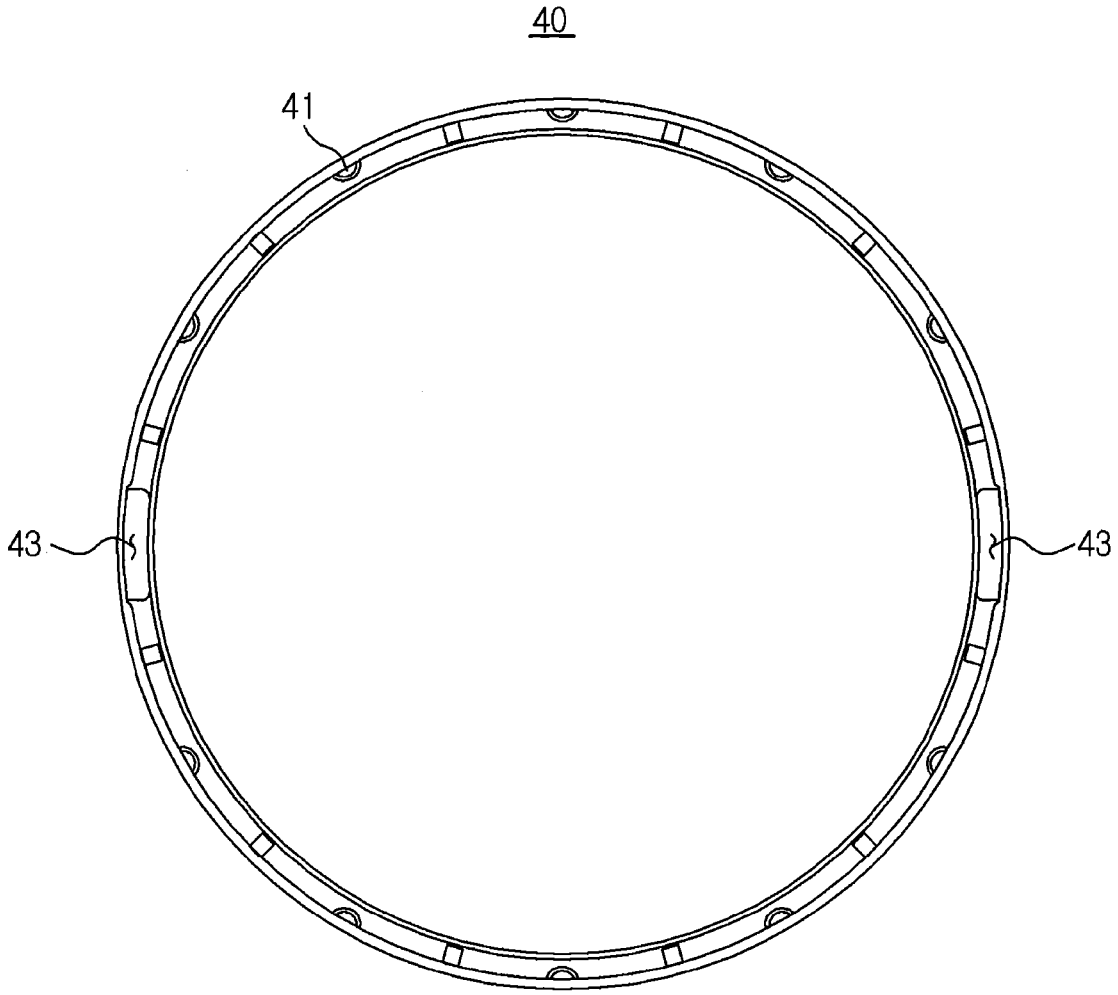
FIG. 5 is a plan view illustrating of the balance ring of the washing machine according to the embodiment of the present disclosure.
Figure 6:
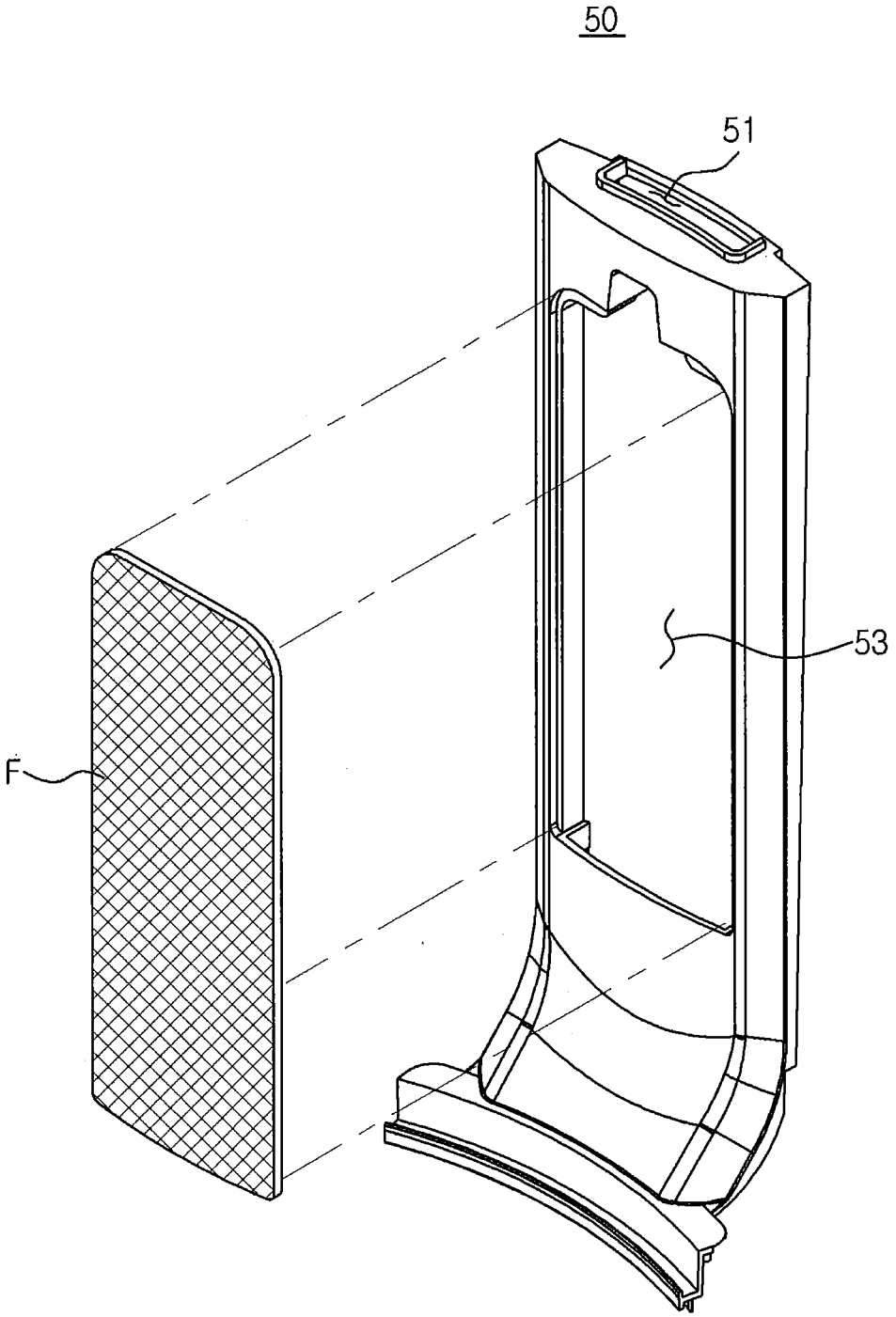
FIG. 6 is a perspective view illustrating a guide water filter of the washing machine according to the embodiment of the present disclosure.
Figure 7:
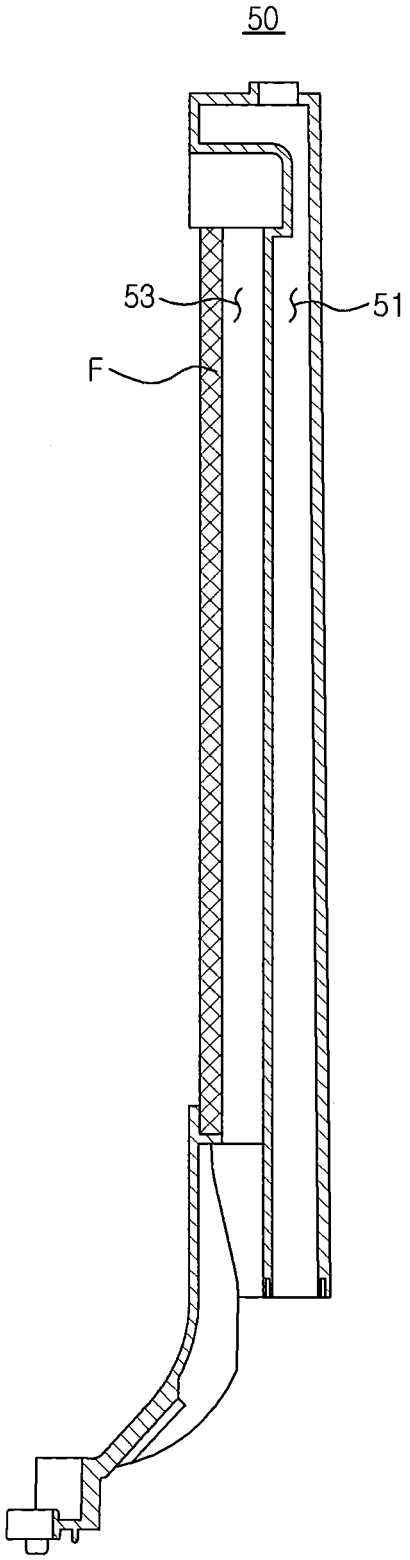
FIG. 7 is a side-sectional view illustrating the guide water filter of the washing machine according to the embodiment of the present disclosure.

Referring to FIGS. 2 and 5, the balancing ring 40 is installed at the upper side of the rotary tub 20 to store the washing water which has moved to the upper side of the rotary tub 20 in the spin-drying operation, and to discharge the stored water to outside.

The balance ring 40 includes a plurality of inlets 41 to receive the washing water, which has moved to the upper side of the rotary tub 20 in the spin-drying operation, at least one outlet 43 to discharge the washing water having been received through the plurality of inlets 41 to outside, and a cover 45 coupled to the upper side of the balance ring 40 to seal the inside the balance ring 40.

Although the washing machine shown in the accompanied drawings includes two outlets 43, the number of outlets is not limited thereto. According to another embodiment, the washing machine may include two or more outlets.

In the spin-drying operation, the washing water, which has moved to the upper side of the rotary tub 20 and is introduced to the plurality of inlets 41 of the balance ring 40, is discharged through the outlet 43. The outlet 43 is connected to the drain passage 51 formed on the guide water filter 50 that will be described later in detail, so that the washing water discharged through the outlet 43 moves from the upper side to the lower side of the rotary tub 20 through the drain passage 51.

Referring to FIGS. 2 and 3 and FIGS. 6 and 7, the guide water filter 50 includes the drain passage 51 and a water filter mounting part 53. The drain passage is provided at the rear surface of the guide water filter 50 to discharge the washing water discharged from the outlet 43 of the balance ring 40 to outside. The water filter mounting part 53 is configured to mount a water filter (F).

The guide water filter 50 is vertically installed at the upper surface of the rotary tub 20, and is mounted on the protrusion part 23 inside the rotary tub 20.

The water filter (F) is mounted on the water filter mounting part 53 that is formed on the front surface of the guide water filter 50 to filter out foreign substances in the washing water.

The drain passage 51 formed on the rear surface of the guide water filter 50 serves as a passage transporting the washing water, which has moved to the upper side of the rotary tub 20 and to the lower side of the rotary tub 20.

Since the protrusion part 23 of the rotary tub 20, to which the guide water filter 50 is mounted, is provided with inclination to have a diameter increasing from the upper side to the lower side of the sidewall 21, the drain passage 51 formed at the rear surface of the guide water filter 50 has an area increasing from the upper side to the lower side of the sidewall 21 to correspond to the inclination surface of the protrusion part 23 so that the guide water filter 50 is vertically installed to the upper surface of the rotary tub 20.

Similar to the case that the washing water smoothly moves from the lower side to the upper side of the rotary tub 20 through the inclined sidewall based on centrifugal force, the configuration of the drain passage 51 having an area increasing from the upper side to the lower side of the sidewall 21 enables the water, which has reached the upper side of the rotary tub 20, to effectively move to the lower side of the rotary tub 20 along the drain passage 51.

The upper side of the drain passage 51 formed on the guide water filter 50 is connected to the outlet 43 of the balance ring 40, and the lower side of the drain passage 51 is connected to the guide part 61 of the base 60 that will be described later.

Accordingly, the same number of the guide water filter 50 having the drain passage 51, the outlet 43 of the balance ring 40, and the guide part 61 of the base 60 are provided.

As described above, in order to move the washing water having reached the upper side of the rotary tub 20 to the lower side of the rotary tub 20, the drain passage 51 transporting the washing water is disposed inside the rotary tub 20, thereby removing the need of an additional drain structure between the rotary tub 20 and the cabinet 10, and thus increasing the capacity of the rotary tub 20 in the washing machine and also increasing the washing capacity without enlarging the appearance of the washing machine.

The base 60 is installed at the lower side of the rotary tub 20, and includes the guide part 61 which is connected to the drain passage 51 of the guide water filter 50.

Since the guide part 61 of the base 60 is connected to the drain passage 51 of the guide water filter 50, the washing water, which has been stored in the upper side of the rotary tub 20 and then moved to the lower side of the rotary tub through the drain passage 51 of the guide water filter 50, passes through the guide part 61 of the base 60 to be stored in the support plate 70 that will be described later.

Figure 8:
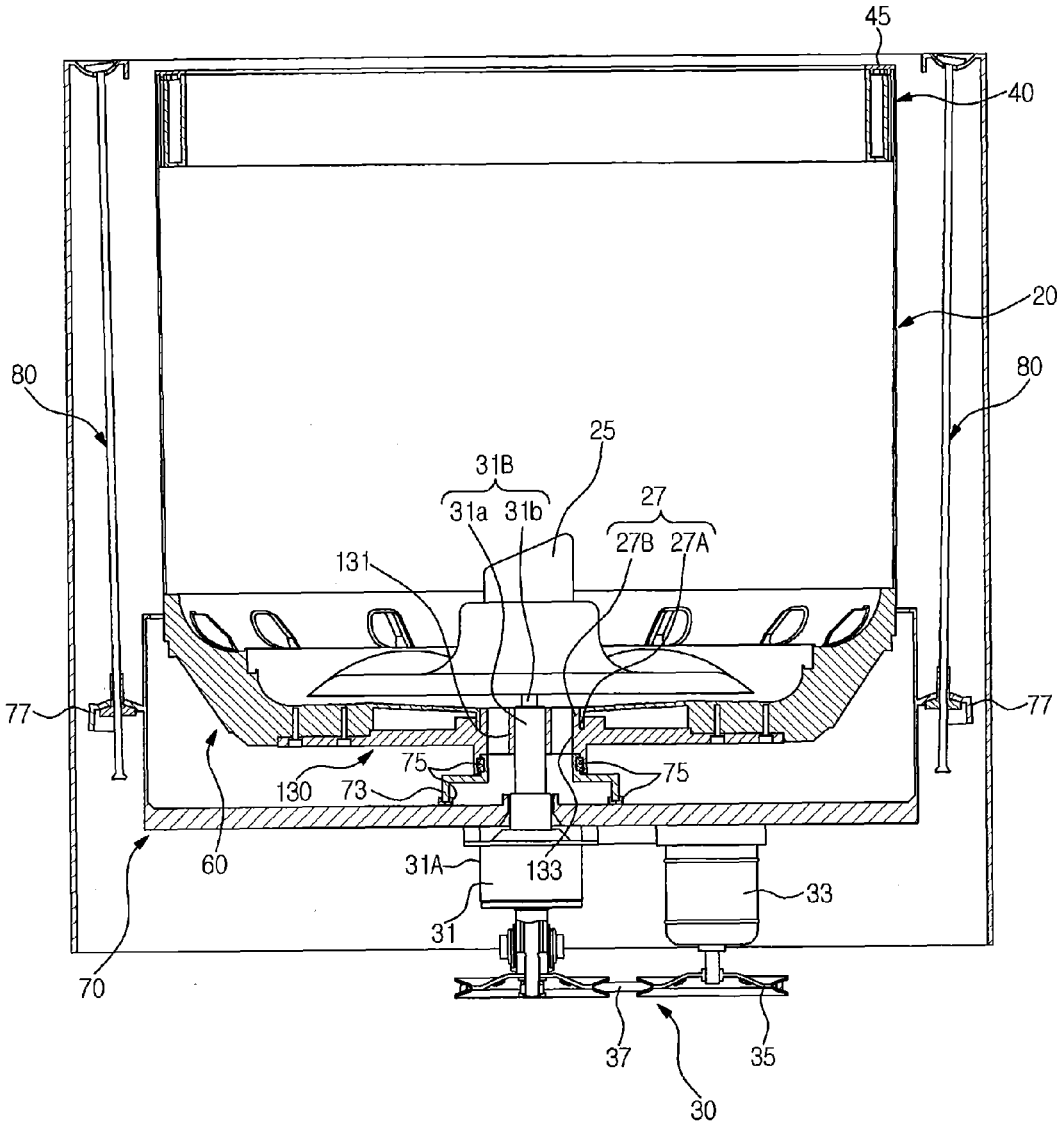
FIG. 8 is a sectional view illustrating the washing machine of FIG. 1 having a suspension member connected thereto.

Referring to FIGS. 3 and 8, the support part 70 is installed at the lower side of the rotary tub 20 to support the rotary tub 20, and includes a drain hole 71 and a connecting bracket 77. The drain hole 71 is configured to discharge the washing water to outside. The connecting bracket 77 is coupled to a suspension member 80.

The support plate 70 stores the washing water, which has been discharged through the guide part 61 of the base 60, and then discharges the stored washing water to outside through the drain hole 71.

The support plate 70 is coupled to the upper side of the cabinet 10 through the suspension member 80. One side of the suspension member 80 is coupled to the upper side of the cabinet 10, and the opposite side of the suspension member 80 is coupled to the connecting bracket 77 formed on the support plate 70.

The support plate 70 and the connecting bracket 77 may be separately manufactured, and are coupled to each other. Alternatively, the support plate 70 may be integrally formed with the connecting bracket 77.

In the washing operation, the vibration generated through rotation of the rotary tub 20 is transferred to the suspension member 80 through the support plate 70, and the suspension member 80 attenuates the vibration that is generated by the rotation tub 20.

Referring to FIG. 3, the driving apparatus 30 to driving the rotary tub 20 or the pulsator 25 disposed inside the rotary tub 20 is coupled to the lower side of the rotary tub 20.

The driving apparatus 30 includes the clutch 31, the driving motor 33, a flange member 130, and the support plate 70. The clutch 31 selectively rotates the rotating tub 20 and the pulsator 25. The driving motor 33 drives the clutch 21. The flange member 130 connects a driving shaft 31B of the clutch 31 to the base 60 of the rotary tub 20 to transfer the rotary force of the driving shaft 31B to the rotary tub 20. The support plate 70 serves to fix the clutch 31 and the driving motor 33.

The base 61 is provided in the middle thereof with a shaft coupling part 27 which is coupled to the flange member 130 to fix and support the flange member 130.

The shaft coupling part 27 includes an shaft coupling wall 27A and a shaft inserting hole 27B. The shaft coupling wall 27 protrudes downward from the base 60 to the outside the rotary tub 20. The shaft inserting hole 27B is formed in the inner side of the shaft coupling wall 27A such that one end of the flange member 130 is inserted to the inside the rotary tub 20 through the shaft inserting hole 27B.

The shaft inserting hole 27B has the flange member, which couples the driving shaft 31B to the rotary tub 20, inserted and fixed thereto.

The flange member 130 is provided at the center thereof with a first through hole 131, which allows the flange member 130 to be coupled to the driving shaft 31B, and is provided with at least one second through hole 133 formed around the first through hole 131 in a circumferential direction.

The second through hole 133 serves as a passage to transport the washing water, which has been stored in the rotary tub 20, to the outside the rotary tub 20 after the washing operation is finished.

The clutch 31 includes a housing 31A and the driving shaft 31B which is rotatably coupled to the center of the housing 31A.

The housing 31A accommodates various types of bearings that rotatably support the driving shaft 31B, and decelerating apparatuses to decelerate the driving shaft 31B.

The driving shaft 31B is connected to the rotary shaft 20 and to the pulsator 25 by passing through the first through hole 131 formed through the flange member 130.

The driving shaft 31B includes a first connecting part 31*a*, which is coupled to the first through hole 131, and a second connecting part 31*b*, which extends from the first connecting part 31*a* to be coupled to the pulsator 25.

The first connecting part 31*a* and the second connecting part 31*b* may separately or simultaneously rotate depending on whether the operation mode is a washing mode or the spin-drying mode. During the washing operation, the second connecting part 31*b* rotates to rotate the pulsator 25 that is coupled to the second connecting part 31*b*. During the spin-drying operation, the first connecting part 31*a* and the second connecting part 31*a* simultaneously rotate to rotate both of the rotary tub 20 and the pulsator 25.

The opposite end of the driving shaft 31B is coupled to the pulley 35 to transfer the rotary force of the driving motor 33 to the clutch 31.

A support plate cover 73 is coupled between the flange member 130 and the support plate 70. The support plate cover 73 communicates with the second through hole 133 such that the support plate 70 and the support plate cover 73 form a space allowing the washing water introduced from the second through hole 133 to move to a drain case 140.

In addition, a sealing member 75 is inserted between the flange member 130 and the support plate cover 73, and between the support plate cover 73 and the support plate 70 to prevent the washing water from leaking.

The drain case 140 is coupled to the lower side of the support plate 70.

The drain case 140 receives the washing water which is introduced by transporting through the space formed by the support plate cover 73 and the support plate 50.

The drain case 140 is provided at one end thereof with a drain pipe 141 to drain the washing water that is introduced to the drain case 140. The first drain hole (H1) is connected to the drain pipe 141 to guide the washing water to the outside the cabinet 10.

A drain valve 143 is provided on the drain plate 141 to selectively drain the washing water inside the rotary tub 20 in the washing operation.

The washing water having been used during the washing operation or the rinsing operation is introduced to the space between the support plate cover 73 and the support plate 70 through the second through hole 133 formed through the flange member 130, and then is drained to the outside the cabinet 10 through the drain case 140 and the first drain hose (H1).

Figure 9:
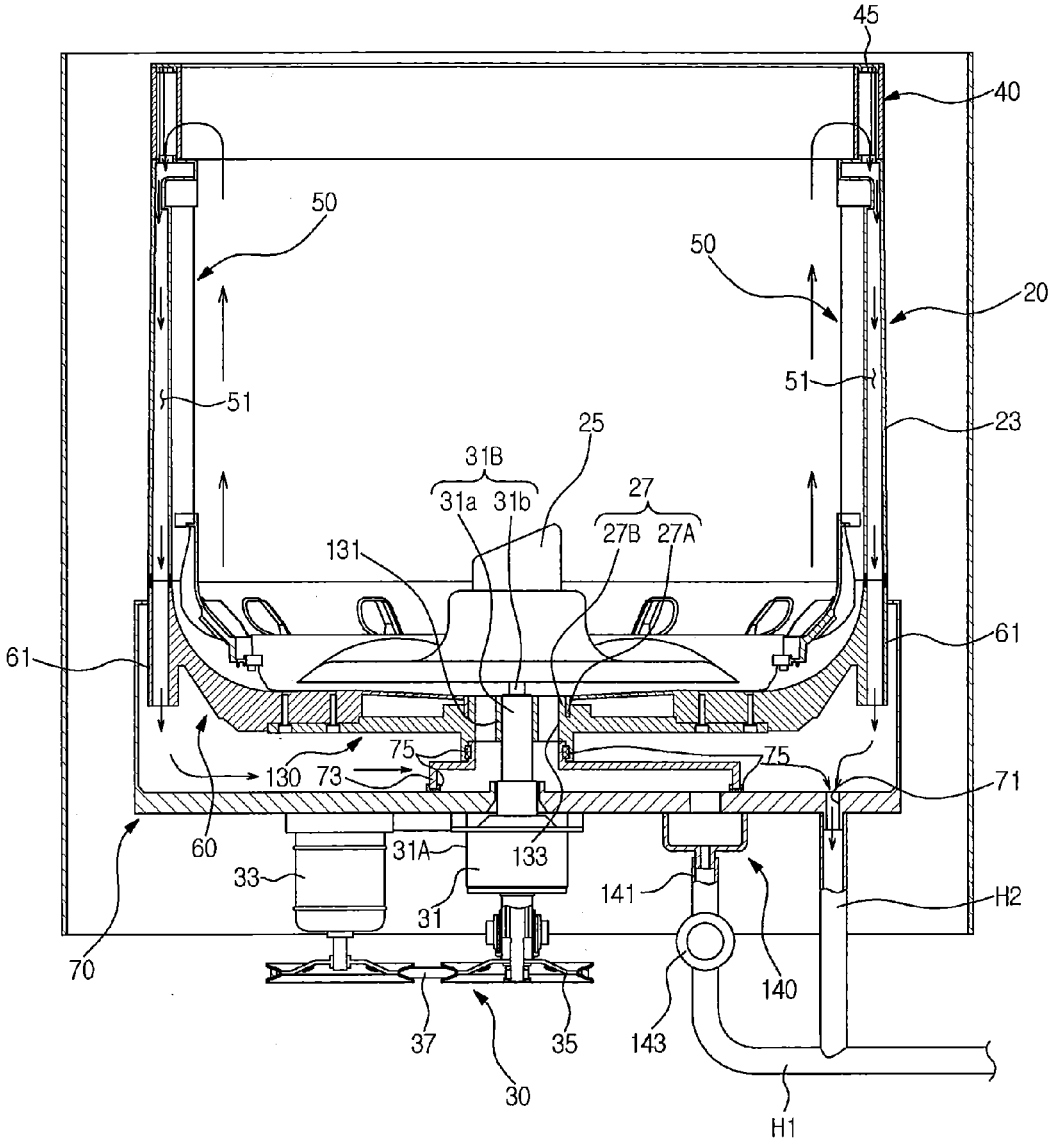
FIG. 9 is a view showing a process of draining washing water in a spin-drying operation of the washing machine according to the embodiment of the present disclosure.

As described above, the washing water separated from the laundry in the spin-drying operation moves to the upper side of the rotary tub 20 along the sidewall 21 of the rotary tub 20 as shown in FIG. 9, enters to the inlet 41 of the balance ring 40, comes out of the outlet 43 of the balance ring 40, and moves to the lower side of the rotary tub 20 along the drain passage 51 formed on the guide water filter 50. The washing water having reached to the lower side of the rotary tub 20 through the drain passage 51 moves to the support plate 70 through the guide part 61 of the base 60, and then is drained to the outside the cabinet through the drain hole 71 and the second drain hose (H2) connected to the drain hole 71.

As described above, an additional structure to receive the washing water between the cabinet 10 and the rotary tub 20 is omitted, thereby maximizing the spatial efficiency of the interior of the cabinet 10.

In addition, a passage to drop the washing water having reached to the upper side of the rotary tub 20 during the spin-drying operation is formed inside the rotary tub 20, so that an additional drain structure between the cabinet 10 and the rotary tub 20 is omitted, thereby maximizing the spatial efficiency of the interior of the cabinet 10.

That is, the washing capacity is increased by enlarging the rotary tub 20 other than the cabinet 10. In addition, the cabinet 10 is minimized without reducing the rotary tub 20 while maintaining the same washing capacity.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a cabinet forming an external appearance of the washing machine;

a rotary tub disposed to rotate around a driving shaft vertically provided inside the cabinet, the rotary tub and comprising a sidewall which extends with an outward inclination from a lower side to an upper side of the washing machine whereby water in the rotary tub moves to the upper side of the rotary tub along the inner surface of the outwardly inclined sidewall during rotation of the rotary tub, and at least one protrusion part which protrudes outwardly from the sidewall and extends with an outward inclination from an upper side to a lower side of the sidewall whereby water in the protrusion part moves to the lower side of the rotary tub along the inner surface of the outwardly inclined protrusion part during rotation of the rotary tub;

a driving apparatus disposed at a lower side of the rotary tub to rotate the rotary tub;

a balance ring installed at an upper side of the rotary tub to store washing water, the balance ring being configured to discharge the stored washing water from the rotary tub to outside the rotary tub during a spin-drying operation;

a guide water filter mounted on the at least one protrusion part inside the rotary tub and provided at a rear surface thereof with a drain passage to discharge the washing water discharged from the balance ring to outside;

a base installed at the lower side of the rotary tub and comprising a guide part connected to the drain passage formed on the guide water filter; and a support plate installed at the lower side of the rotary tub to support the rotary tub, to store the washing water discharged through the guide part, and to discharge the stored washing water to outside.

2. The washing machine of claim 1, wherein a surface of the sidewall is blocked to prevent the washing water from being discharged to outside through the sidewall of the rotary tub when the rotary tub rotates in the spin-drying operation.

3. The washing machine of claim 2, wherein the protrusion part is integrally formed with the sidewall of the rotary tub.

4. The washing machine of claim 1, wherein the driving apparatus comprises a clutch, which is configured to rotate the rotary tub and a pulsator rotatably disposed inside the rotary tub, and a driving motor configured to drive the clutch.

5. The washing machine of claim 4, wherein the clutch comprises a housing and the driving shaft which is rotatably supported by a bearing coupled to an inner side of the housing, and wherein a flange member is coupled to the lower side of the rotary tub to connect the driving shaft to the rotary tub such that a rotary force of the driving shaft is transferred to the rotary tub.

6. The washing machine of claim 5, wherein the flange member is provided at the center thereof with a first through hole, which allows the flange member to be coupled to the driving shaft, and is provided with at least one second through hole formed around the first through hole to guide the washing water stored inside the rotary tub to outside.

7. The washing machine of claim 1, wherein the balance ring installed at the upper side of the rotary tub comprises a plurality of inlets to receive the washing water discharged from the rotary tub to outside when the rotary tub rotates during the spin-drying operation, and at least one outlet to discharge the washing water having been received through the plurality of inlets to outside.

8. The washing machine of claim 7, wherein the upper side of the drain passage of the guide water filter is connected to the at least one outlet of the balance ring.

9. The washing machine of claim 7, wherein the lower side of the drain passage of the guide water filter is connected to the guide part of the base.

10. The washing machine of claim 1, wherein the guide water filter is vertically installed on the rotary tub, and the drain passage of the guide water filter has an area increasing from the upper side to the lower side of the sidewall to correspond to an inclination surface of the at least one protrusion part.

11. The washing machine of claim 10, wherein the guide water filter comprises a water filter mounting part configured to mount a water filter that filters out foreign substances.

12. The washing machine of claim 1, wherein the support plate stores the washing water discharged through the guide part of the base, and is provided with at the lower side thereof with a drain hole to discharge the washing water stored in the support plate.

13. The washing machine of claim 12, further comprising a suspension member configured to connect the support plate to the upper side of the cabinet such that vibration generated from the rotary tub is absorbed by the suspension member.

14. The washing machine of claim 13, wherein the support plate comprises at least one connecting bracket that connects to the suspension member.

* * * * *